US007779495B2

(12) United States Patent
Paranjpe et al.

(10) Patent No.: US 7,779,495 B2
(45) Date of Patent: Aug. 24, 2010

(54) RESILIENT ROD FOR NECK AND BODY SUPPORT AND COMFORT

(76) Inventors: Prabhakar D. Paranjpe, 4033 Stonecroft Dr., St. Charles, MO (US) 63304; Amod P. Paranjpe, 300 Femme Osage Valley, Augusta, MO (US) 63332

( * ) Notice: Subject to any disclaimer, the term of this patent is extended or adjusted under 35 U.S.C. 154(b) by 0 days.

(21) Appl. No.: 12/221,754

(22) Filed: Aug. 5, 2008

(65) Prior Publication Data

US 2009/0056024 A1 Mar. 5, 2009

Related U.S. Application Data

(60) Provisional application No. 60/966,464, filed on Aug. 28, 2007.

(51) Int. Cl.
*A47C 20/00* (2006.01)
*A47G 9/00* (2006.01)

(52) U.S. Cl. ..... 5/643; 5/636

(58) Field of Classification Search ..... 5/643, 5/636, 632, 630, 655, 652, 655.9, 953; 606/240
See application file for complete search history.

(56) References Cited

U.S. PATENT DOCUMENTS

| | | | | | |
|---|---|---|---|---|---|
| 1,385,355 | A | | 7/1921 | Bank | |
| 1,890,358 | A | * | 12/1932 | Barcalo | 5/640 |
| 3,234,569 | A | * | 2/1966 | Stewart | 5/636 |
| 3,378,860 | A | * | 4/1968 | Frazier | 5/491 |
| 3,719,185 | A | * | 3/1973 | Hanes | 606/240 |
| 3,802,704 | A | * | 4/1974 | Genua | 273/336 |
| 3,842,453 | A | * | 10/1974 | Redfield | 5/643 |
| 3,899,797 | A | * | 8/1975 | Gunst | 5/655.3 |
| 4,081,870 | A | * | 4/1978 | Iannucci | 5/652 |
| 4,222,468 | A | * | 9/1980 | De Fries | 190/102 |
| 4,761,872 | A | * | 8/1988 | Buettner et al. | 29/451 |
| 5,359,739 | A | * | 11/1994 | Rains et al. | 5/81.1 R |
| 5,371,909 | A | * | 12/1994 | McCarty | 5/655 |
| 5,425,567 | A | | 6/1995 | Albecker, III | |
| 5,450,640 | A | * | 9/1995 | Patton et al. | 5/655 |
| 5,530,974 | A | * | 7/1996 | Rains et al. | 5/81.1 T |
| 5,615,928 | A | * | 4/1997 | Penley | 297/452.56 |
| 5,675,850 | A | * | 10/1997 | Schmitt | 5/630 |
| 5,689,844 | A | | 11/1997 | Liu | |
| 5,732,426 | A | * | 3/1998 | Furuya et al. | 5/636 |
| 5,740,571 | A | * | 4/1998 | Tyra | 5/624 |
| 5,824,013 | A | * | 10/1998 | Allen | 606/240 |
| 5,926,879 | A | | 7/1999 | Davis | |
| 5,926,880 | A | | 7/1999 | Sramek | |
| 5,937,461 | A | * | 8/1999 | Dombrowski et al. | 5/655 |
| 5,953,779 | A | | 9/1999 | Schwartz | |
| 6,345,401 | B1 | | 2/2002 | Frydman | |
| 6,360,388 | B2 | * | 3/2002 | Langer | 5/632 |
| 6,381,784 | B1 | | 5/2002 | Davis | |

(Continued)

*Primary Examiner*—Robert G Santos
(74) *Attorney, Agent, or Firm*—Paul M. Denk

(57) ABSTRACT

A composite rod design having a core element, the core element made of at least one flexible and resilient core, a foam cell material shaped into annulus configuration and having the core element snuggly located therein, the foam cell material having a length of at least equal to the length of the core element, and an outer covering provided upon the foam cell material and wrapped around the composite rod design to the extent necessary to provide the necessary diameter for the composite rod for convenient usage.

1 Claim, 3 Drawing Sheets

U.S. PATENT DOCUMENTS 6,449,788 B1 * 9/2002 Nichols ..... 5/636
6,481,032 B2 * 11/2002 Milano et al. ..... 5/655
6,513,179 B1 2/2003 Pan
7,108,646 B1 * 9/2006 Quick ..... 482/148
7,185,378 B2 * 3/2007 Smith ..... 5/642
7,203,983 B1 4/2007 Reeves et al.
2001/0009043 A1 * 7/2001 Langer ..... 5/632
2006/0265808 A1 11/2006 Phillips
2009/0056024 A1 * 3/2009 Paranjpe et al. ..... 5/643
2009/0222994 A1 * 9/2009 Wood ..... 5/655.9

* cited by examiner

RESILIENT ROD FOR NECK AND BODY SUPPORT AND COMFORT

CROSS-REFERENCE TO RELATED APPLICATION

This non-provisional patent application claims priority to the provisional patent application having Ser. No. 60/966,464, which was filed on Aug. 28, 2007.

FIELD OF INVENTION

The invention relates to a rigid-flex composite rod design that could be used with a conventional pillow to deliver added neck and body support to its user. The rod's core is designed to mimic flexibility of the vertebrae while with the outer skin is made of layers of semi-rigid, cushion comfort materials. Furthermore, the composite rod diameter is adjustable to suit any neck size by simply wrapping or unwrapping the layers of the outer cover. Once adjusted the composite rod will hold its shape permanently while maintaining its 3-dimensional flexibility and would deliver the necessary orthopedic support to user's neck, shoulder and overall body.

BACKGROUND OF THE INVENTION

Obviously, there have long been available in the art various types of neck supports, and body supports, but usually these types of wedges are normally designed in the configuration of a wedge, that may be placed under the head, neck and upper torso, in order to elevate the user such as to facilitate reading in bed, or elsewhere. There have been numerous patents that have issued over the past few decades on the subject of a pillow type designs and which claim to deliver support for the head and neck. For example, U.S. Pat. No. 1,385,355, to Banks, shows one such device. A most recent U.S. Pat. No. 7,203,983, to Reeves, shows a related device.

It is also found that the consumer today has a multitude of choices of selection and purchase of various styles of neck support pillows, for use for either comfort, medicinal, or other purposes.

In review the various patents that have issued relating to this type of technology, it has been found that most of such prior art designs lack, initially, shape stability, in addition to three-dimensional flexibility to accommodate muscle relaxation and a persons changing sleep positions.

The current invention is designed to address these deficiencies in the prior art, and to give the user a new apparatus that can be used with any conventional pillow, and yet provide significant stability to the upper back and neck of the user, to mimic the flexibility of vertebrae, and which can support varied in diameter, depending upon the need and requirements of the user.

The Reeves, et al, U.S. Pat. No. 7,203,983, as previously alluded to, shows a pillow apparatus with a hollow core formed thereon.

The patent to Pan, U.S. Pat. No. 6,513,179, discloses a pillow, of sponge material, having an open chamber therein.

The patent to Davis, et al, U.S. Pat. No. 6,381,784, shows a pillow with improved head traction. This device includes a series of raised ribs, to add comfort to the user's head and neck.

The patent to Frydman, U.S. Pat. No. 6,345,401, shows another neck support pillow. This is made of a plurality of layers that are secured together by tongue-and-groove, to form its supporting structure.

The patent to Davis, U.S. Pat. No. 5,926,879, shows another form of shaped pillow.

The patent to Schwartz, U.S. Pat. No. 5,953,779, shows a composite mattress assembly.

The patent to Sramek, U.S. Pat. No. 5,926,880, shows an adjustable cervical pillow with depressions for accommodating the user's ears.

The patent to Liu, U.S. Pat. No. 5,689,844, shows another form of pillow.

The patent To Albecker, III, U.S. Pat. No. 5,425,567, shows a back rest/legless leisure chairs and methods for making cushions.

The patent to Banks, U.S. Pat. No. 1,385,355, shows a multi contoured pillow or the like object.

The published application No, US2006/0265808, to Phillips, is upon a face cradle pillow. These are examples of the prior art known to the applicants.

SUMMARY OF THE INVENTION

This invention relates to a rigid-flex composite rod design, or a resilient rod type of design, that can be used with a conventional pillow to deliver added neck and body support to its user. The rod's core is designed to mimic flexibility, through resiliency, of the vertebrae while the outer skin is made of layers of semi-rigid, cushion comfort materials. This may be a cloth, a towel, or any other type of covering that can be added and wrapped to the rod, or removed, in order to vary the diameter of its design. The preferred material of construction for the core is a twisted polypropylene rope, obviously, any type of polymer, rather it be of the styrene type, polyethylene, or even a standard rope such as of hemp, or any other type of materials, that can be used individually, wrapped until a desired diameter is achieved, which then can be placed within a covering, in order to provide for the rod structure. Then, an outer wrap, even such as a towel, can be wrapped around the constricted rod, and to the diameter of the structure desired, in usage. The essence of the invention, though, is to provide a rod which has some degree of resiliency, and not be totally hard in texture, so as to provide for full support, with some flexibility, but yet be of comfort to its user.

In the prototype design, ropes of polypropylene, having an a nominal outside diameter of approximately ⅜", are twisted and held together using a type of a fastening means, such as a wide electrical or other tape, and this type of composite forms the inner core at an approximate ⅝" outside diameter, for the structured rod. The inner core is then encapsulated into an Armacell foam insulation, having a size of approximately ⅝" inside diameter, by ⅜" nominal wall thickness. All of these construction materials are available upon the market, for fabrication into the rod design of this invention.

During testing, the foam seam liners were removed and pressure was applied to seal the seam of the foam for thus forming the cylindrical skeleton of the composite rod. Furthermore, the composite rod's outside diameter is made adjustable to suit any neck size by simply wrapping or unwrapping the layers and outer covering. Such covering may comprise multiple wraps of, for example, a cotton hand towel, or even a bath towel, where a larger diameter is needed, and these were sufficient to make the outside diameter of the prototype rod into the vicinity of approximately 1¾" OD. The length of the prototype is in the vicinity of 21" long, but obviously other lengths may be desirable. Once adjusted, the composite rod holds its shape permanently while maintaining its three-dimensional flexibility. The prototype has been used, by putting such a rod under the conventional pillow, and it has been found to deliver the necessary orthopedic support to the neck, shoulder, and overall body, during usage. It definitely improves the sleep comfort level and has relieved the morning neck and shoulder stiffness, normally experienced by many people, particularly the elderly. Furthermore, it seemed to have the benefit of reducing lower back pain for patients.

In view of the foregoing, the main object of the current invention is to provide a new apparatus in the manner of a rigid-flex composite rod design that can be used with a conventional pillow to deliver added neck and body support to its user, thus improving sleep comfort level, and to add to the overall comfort and quality of life.

These and other objects may become more apparent to those skilled in the art upon reviewing the summary of the invention herein, and upon undertaking a study of the description of its preferred embodiment, in view of the drawings.

BRIEF DESCRIPTION OF THE DRAWINGS

In referring to the drawings, FIG. 1 discloses the composite rod in cross section applied under the conventional pillow and neck of the user.

DESCRIPTION OF THE PREFERRED EMBODIMENT

Figure 1:
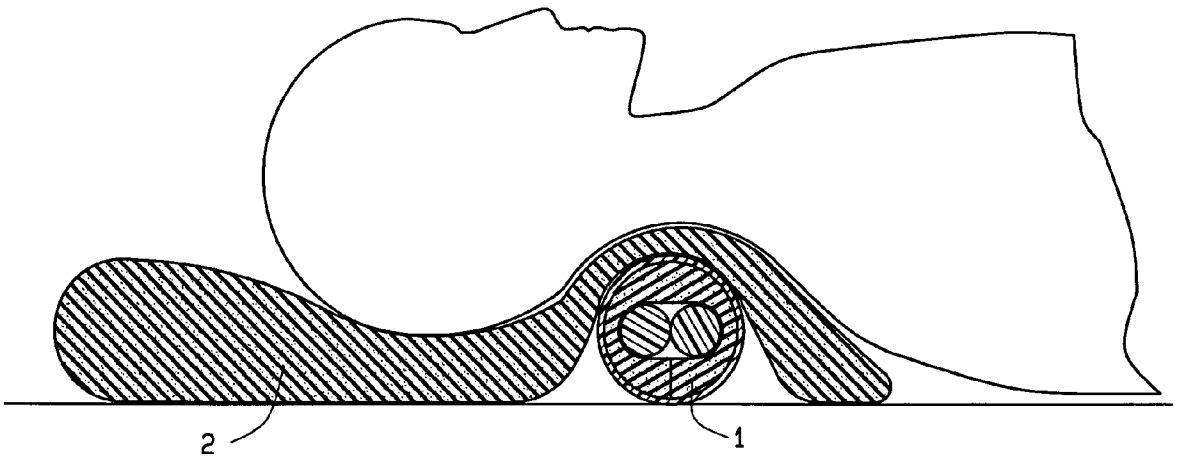

In the described figures for this invention, they generally illustrate the present invention and at least a number of exemplary embodiments. In general, the present invention provides a detail design to build the rigid-flex composite rod, or one that is resilient in usage, and can be used with a conventional pillow to deliver added neck and body support to its user. As can be seen in FIG. 1, the user is laying in a prone position, showing how the rod 1 is arranged under a conventional pillow 2, with the user resting thereon, at the region of the neck.

The rod's core element is designed to mimic the flexibility of the vertebrae of the user, while the outer skin layers of the covering means, being semi-rigid, but having some resiliency, is surrounded by cushion comfort materials. Furthermore, the composite rod diameter is obviously adjustable to suit any neck size by simply wrapping or unwrapping layers of an outer covering, over the composite rod, once formed. Once adjusted, the composite rod holds its shape permanently while maintaining its three-dimensional flexibility and delivering the necessary orthopedic support to the user's neck, shoulder and upper regions of the body, as can be seen in this FIG. 1.

Figure 2:
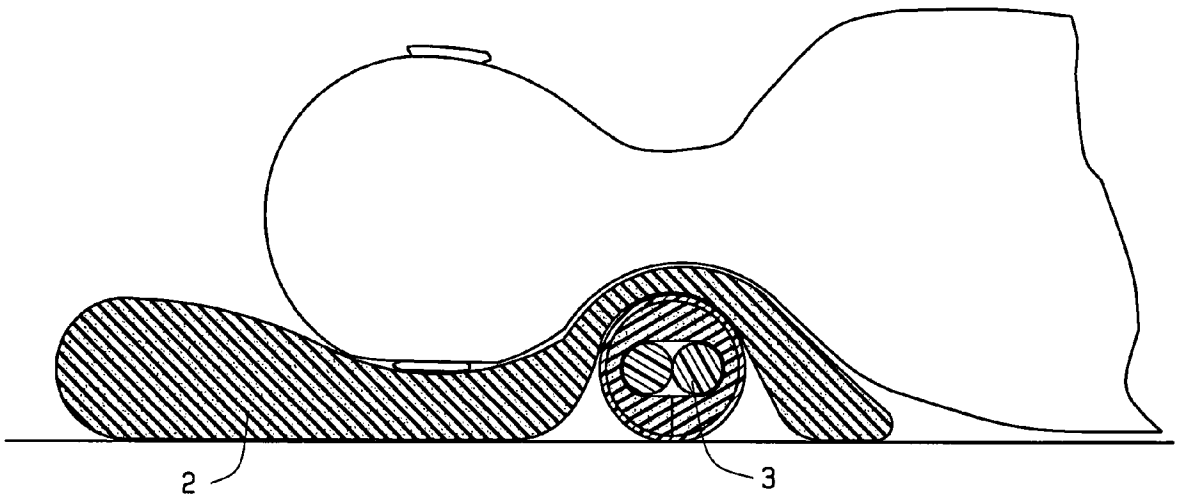
FIG. 2 shows the composite rod under the neck of the user, when sleeping on a side.

FIG. 2 shows how the composite rod may be formed of a pair of core means, as will be subsequently described, in order to increase the diametric dimension of the support, during usage. As noted, the conventional pillow 2 is still utilized, but the composite rod, formed of a pair of inner core members, twisted upon themselves, can be seen at 3.

Figure 3:
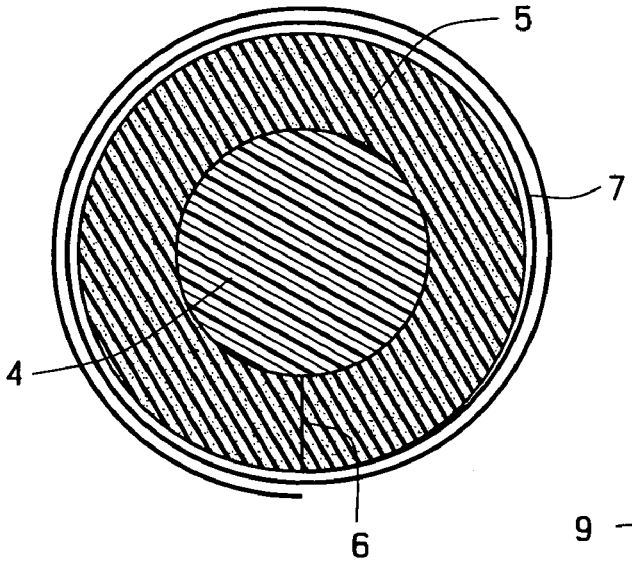
FIG. 3 shows a cross section of a composite rod with a singular core element.

FIG. 3 shows a basic design for the composite rod. As noted, it includes a core means 4 which may be formed of rope, or any type of polymer, that may have some resiliency to it, of the type as previously reviewed, and which extends the length of the formed composite rod. An outer foam cellular material 5 is applied around the core's circumference, and the edges of the foam material as at 6, may be of an adhesive, or pressure sensitive adhesive, to allow the foam cell to be applied in place, surrounding the core, permanently. Then, an outer skin layer 7 is applied, which may be wrapped of one or more wraps around the foam material, in order to enhance an increase the overall diameter of the support device, as may be required by the user.

Figure 4:
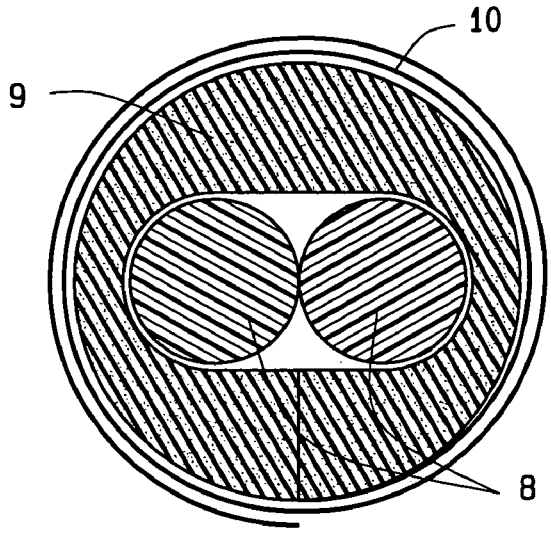
FIG. 4 shows a composite rod with a dual and twisted core element.

FIG. 4 discloses how a pair of core elements 8 can be used, such as lengths of rope, or flexible polymer rods, and which may be twisted about each other, to form the desired core element that may exhibit some resiliency, but fully adds to the support of the device, during usage. These core elements can also be made of any rope, polymer, or any other resilient type material, even such as rubber, that may provide stable support under the neck of the user, in order to maintain the vertebrae in proper alignment, and even enhance the user's health during application. It can be seen that this embodiment includes the foam insulation 9, that surrounds the composite core, as previously described, and also has the outer skin or wrap, as at 10, which may be formed of layers of a cotton towel, or other type of cloth or covering material.

Figure 5:
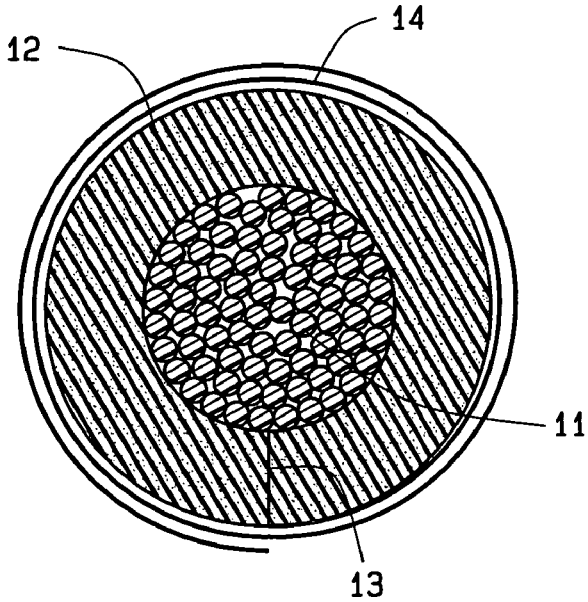
FIG. 5 shows the composite rod with a multiple core element.

FIG. 5 shows how the inner core 11 may be formed of a plurality or multiple twists of rope, polymer, rubber, or other material that can form a firm core, but yet have some resiliency, for the comfort of the user during application. The foam cell material 12 is provided around the perimeter of the core, to add to the cushioning effect, and has its adhesively adhered ends, as at 13, tied together to form the outer cushioning for the core, during usage. Then, the outer skin layer 14, as previously explained, can be a wrap of a soft cloth material, preferably having some bulk, such as a towel, so that the number of wraps applied will vary the diameter of the overall support device, at the desire and to the comfort of the user. Obviously, any other type of outer covering, such as in the manner of a pillow like case could be applied, if the diameter is not critical.

Obviously, upon reviewing the description of these devices, the composite rod diameter is adjustable to suit any neck size by simply wrapping or unwrapping the layers of the outer cover. Once adjusted, the composite rod holds its shape permanently while maintaining that three-dimensional flexibility and delivers the necessary orthopedic support to the user's neck, shoulder, and the like.

Pillow shape stability, as defined for this invention, is provided in order to maintain its shape and consistency, continually during sleep of the user, and not to have any dimensional changes during usage, such as occurs with any prior art type of conventional pillow, that will change its shape depending upon the position of the sleeper, when used. This is because the inherent property of any cushion material which is used in any pillow construction can be varied depending upon the pressure applied by the user. The cushion material resiliency in a pillow is different and its distribution is different but basically it is still a cushioning material used in any pillow construction, and therefore its shape is subject to change. Cushion property in prior art devices lack the "pillow shape stability," when added to the user's changing positions which are involuntary movements during sleep, and it can be appreciated that prior art pillow designs can not provide the intended steady and stable orthopedic support to the user's neck, shoulder, and overall body, during application.

It should further be noted that the present support rod has a core element that is designed to mimic the flexibility of the vertebrae. This is completely unique in its design feature for the present invention. The prototype that is currently being researched, by placing it under the conventional pillow, has been found to deliver the necessary orthopedic support to the neck, shoulder and overall body. It has definitely improved the sleep and comfort level, and has relieved any morning neck and shoulder stiffness, during usage. Through usage of the current invention, lower back pain has also been found to dissipate, if not totally disappear. It has further been found that the present invention support system applies just the correct amount of pressure and provides sustained massage like attributes to the desirable pressure points upon the anatomy of the user, and in such fashion it has a tendency to relieve the body back stress and pain, as has been found.

The foam insulation that surrounds the core, is generally marketed as a foam pad, under the brand name Armacell, generally has a thickness, when applied in this support device, of approximately ⅝" inside diameter, and normally a ⅜" nominal wall thickness. All such construction materials are available, and can be used to form the support device of this invention. The foam seam liners can be sealed together at their edges, and applying an adhesive, or pressure sensitive adhesive, such as a tape, to the end seams, and in this manner when formed, furnishes a cylindrical skeleton for the composite rod for surrounding, the formed core, during manufacture. Furthermore, the composite rods outside diameter is made adjustable to suit any neck size by simply wrapping or unwrapping further layers of the outer covering upon the composite support, and as previously described, usually three wraps of a cotton hand towel, or any equivalent or related type of material, were sufficient to make the outside diameter of the prototype rod to achieve a dimension of approximately 1¾" in diameter. Generally, the length of the probe will be in the vicinity of 1½' to 2', but in the preferred prototype, it was found that a 21" long support system provides sufficient width. Once adjusted, the composite rod holds its shape permanently while maintaining a three-dimensional flexibility in its usage. The prototype experimentation has been found to function adequately. It has been found that for both sleeping positions, that is, on the side and face up positions, both are equally comfortable and most importantly the arrangement is not intimidating because the user is using it with his/her everyday pillow. It has been found to deliver the necessary orthopedic support to the neck, shoulder, any upper body portions, and it definitely improves the sleep comfort level and relieves the morning neck and shoulder stiffness that some people experience. Furthermore, the continued usage of the support device has been found to relieve lower back pain.

It is also possible to put the composite rod over a conventional pillow, or the composite rod could be used by itself without a pillow, and still achieve these advantageous results. As previously reviewed, the various figures of the drawings show the possible alternate composite rod designs, indicating how one or more, or a plurality of core rods may be used, and the device can be made to any suitable length, even equivalent to that of the width of the standard pillow.

As an alternative, the core may also comprise related types of materials, such as a flexible tube, made of polymer, or the like, or even one that maybe filled with an inert granular material and sealed on both ends, yet maintaining some degree of resiliency, for attaining the results desired and required from this particular invention. This is an example of a modified type of core element. Other core elements can comprise a fabric of woven or non-woven material, which may even be shaped into the tubular form, and the granular material could be fine or coarse sand, or related granular material, that yet allows the core to be reasonably resilient, when used.

Another advantage of this particular support rod is that in some cases, people who suffer from stomach problems, or acid reflux, need to have their head elevated during sleep. The device of this invention provides that support and elevation, and maintains it, due to its inherent resiliency, and firmness, for the composite rod of this invention as when used.

Figure 6:
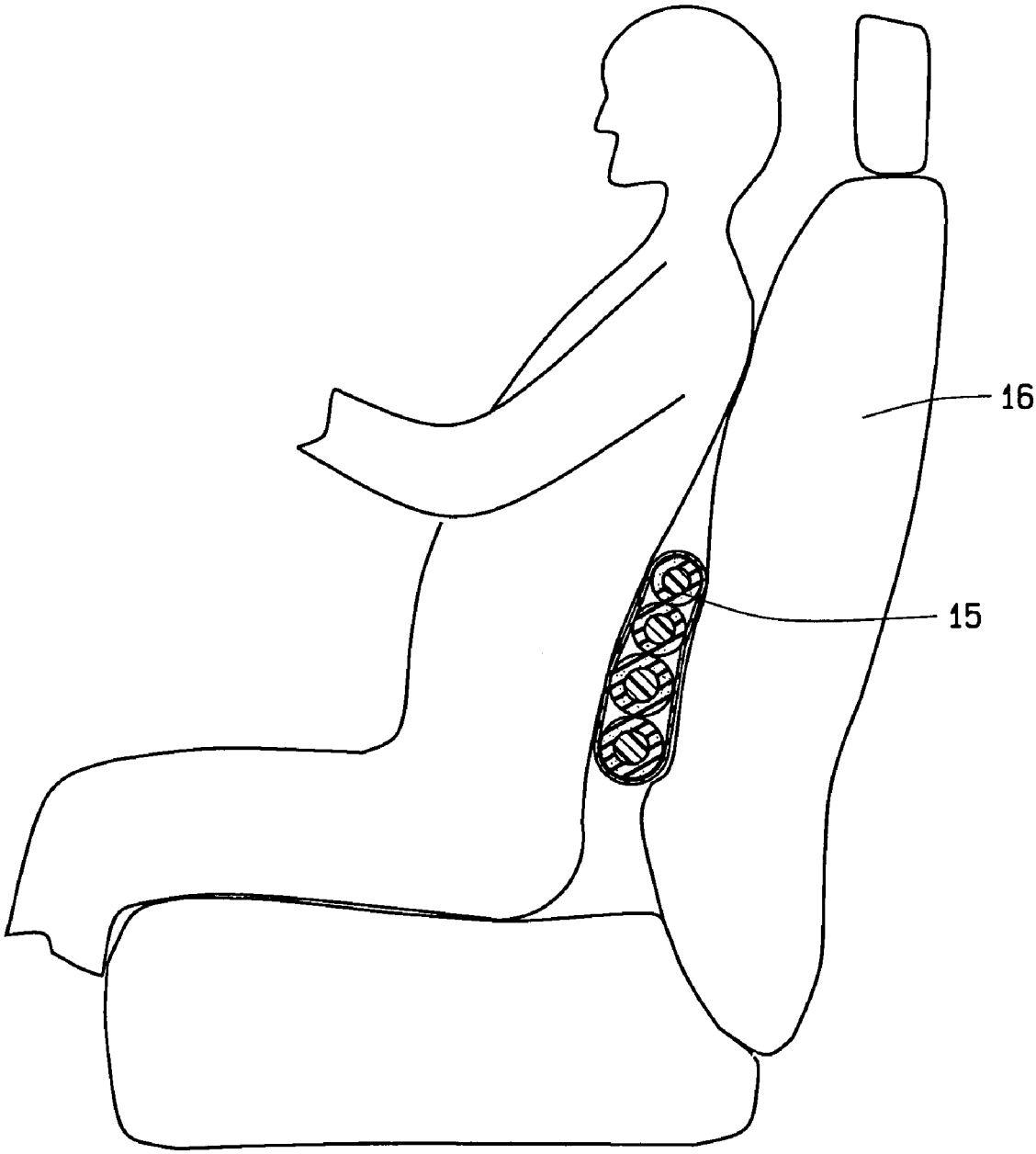
FIG. 6 shows how the composite rods may be embodied within a back rest to add comfort to the user while driving or sitting in a vehicle.

FIG. 6 discloses how the composite rod design of this invention may be included in a multiple configuration, arrange within a casing 15, or pocket, and can be used for adding comfort to the wearer, particularly in the lumbar region of the body. It can be used with a car seat 16 as can be noted, and may include two or more preferably composite rods in its support.

Variations or modifications to the subject matter of this invention may occur to those skilled in the art upon review of the development as provided herein. Such variations, if within the spirit of this development, are intended to be encompassed within the scope of any claims to this invention as set forth. The description of the preferred embodiment, and its depiction in the drawings, is set forth for illustrative purposes only.

What is claimed:

1. A composite resilient rod for a person comprising:

a core element, said core element being made of at least one resilient and flexible core, said composite rod core provided to emulate the flexibility of the vertebrae of the human body during usage, a foam cell material wrapped around said core element, said foam cell material shaped into an annular configuration having a central aperture to encapsulate the core element snuggly therein, said foam cell material having a length at least equal to the length of the core element, said core element being formed of at least one flexible rope, of one of twisted polypropylene and twisted hemp, said foam cell material further comprising flexible foam material, and an outer covering provided upon the foam cell material, the outer covering encasing the foam cell material and the core element providing the necessary diameter for the composite rod during usage in relation to a person's neck, wherein said outer covering includes at least one layer of cushioning comfort material.

* * * * *